US008088274B2

(12) United States Patent
Gilbert et al.

(10) Patent No.: US 8,088,274 B2
(45) Date of Patent: Jan. 3, 2012

(54) PROCESS FOR CATALYTIC CRACKING OF PETROLEUM HYDROCARBONS IN A FLUIDIZED BED WITH MAXIMIZED PRODUCTION OF LIGHT OLEFINS

(75) Inventors: William Richard Gilbert, Rio de Janeiro (BR); Emanuel Freire Sandes, Niterói (BR); Andrea de Rezende Pinho, Rio de Janeiro (BR); Claudia Maria de Lacerda Alvarenga Baptista, Rio de Janeiro (BR)

(73) Assignee: Petroleo Brasileiro S.A. - Petrobras, Rio De Janeiro (BR)

( * ) Notice: Subject to any disclaimer, the term of this patent is extended or adjusted under 35 U.S.C. 154(b) by 78 days.

(21) Appl. No.: 11/957,949

(22) Filed: Dec. 17, 2007

(65) Prior Publication Data

US 2008/0179219 A1 Jul. 31, 2008

(30) Foreign Application Priority Data

Dec. 20, 2006 (BR) ..... 0605327

(51) Int. Cl.
*C10G 11/18* (2006.01)

(52) U.S. Cl. ..... 208/120.01; 208/48 Q; 208/113; 585/651; 585/653

(58) Field of Classification Search ..... 208/48 Q, 208/113, 118, 119, 120.01; 585/651, 653
See application file for complete search history.

(56) References Cited

U.S. PATENT DOCUMENTS

| | | | | |
|---|---|---|---|---|
| 4,764,268 | A | 8/1988 | Lane | |
| 4,818,372 | A | 4/1989 | Mauleon et al. | |
| 5,087,349 | A | 2/1992 | Goelzer et al. | |
| 5,389,232 | A | 2/1995 | Adewuyi et al. | |
| 5,846,402 | A | 12/1998 | Mandal et al. | |
| 5,954,924 | A | 9/1999 | Art | |
| 6,416,656 | B1 | 7/2002 | Zhang et al. | |
| 2005/0163674 | A1 * | 7/2005 | Letzsch | 422/139 |

* cited by examiner

*Primary Examiner* — Walter Griffin
*Assistant Examiner* — Renee E Robinson
(74) *Attorney, Agent, or Firm* — Sughrue Mion, PLLC

(57) ABSTRACT

A process is described for catalytic cracking of hydrocarbon feedstocks from petroleum refining which increases substantially the yields of light olefins. The process limits the extreme conditions to a first reaction section and introduces a stream of cooling fluid above the feedstock injection point so as to maintain a second reaction section under cracking conditions which produce light olefins propene and ethene, and inhibits reactions undesirable for the process.

11 Claims, 2 Drawing Sheets

Figure 1:
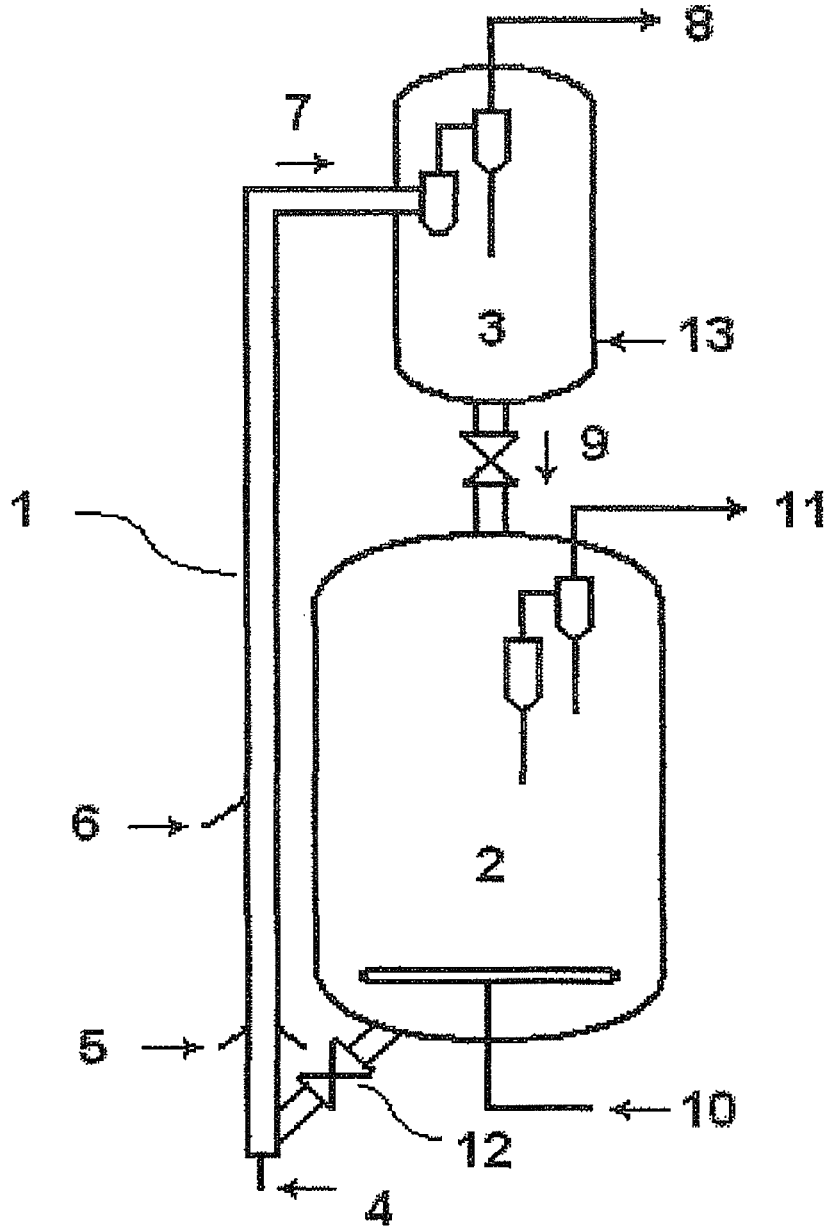

PROCESS FOR CATALYTIC CRACKING OF PETROLEUM HYDROCARBONS IN A FLUIDIZED BED WITH MAXIMIZED PRODUCTION OF LIGHT OLEFINS

FIELD OF THE INVENTION

The present invention pertains to the field of processes for producing light olefins in fluidized catalytic cracking units, and is applicable to feedstocks made up of hydrocarbons with boiling points typical of diesel oil or heavier products of atmospheric distillation of petroleum. The process maximizes the yield of propene, and especially ethene, by injecting a rapid cooling liquid at a point above the point of introduction of the feedstock, so as to create two reaction sections and a controlled temperature profile in the reactor (riser). When compared with the process without injection of the rapid cooling liquid (quenching), gains are noted in conversion to and selectivity for light olefins with simultaneous inhibition of reactions which give rise to undesirable thermal cracking by-products.

BASIS OF THE INVENTION

In a fluidized catalytic cracking unit (UFCC), the hydrocarbon cracking reactions occur by bringing the feedstock into contact with a catalyst in a dynamic flow regime in a tubular reactor (riser), to convert the feedstock into lighter hydrocarbon fractions with greater economic value.

A conventional FCC process converts hydrocarbon fractions from petroleum refining with boiling points between 350 and 550° C. into lighter hydrocarbons, comprising mainly gasoline, which distils in the range 35 to 220° C. In catalysts typically used in the process, the principal active constituent is zeolite Y, and the reaction temperatures in the reactor vary, for example, from about 680° C. immediately prior to the point of contact between the feedstock and the catalyst, to 540° C. at the outlet of the reactor.

UFCCs operating in petrochemical mode process feedstocks from naphthas to atmospheric residues, with the principal objective of the process being to produce hydrocarbons of molecular weight even smaller than those found in gasoline, and especially light olefins of two to four carbon atoms ($C2^{=}$ a $C4^{=}$). In order to attain this objective, the catalyst system is modified, usually by adding to a typical FCC catalyst a specific constituent capable of converting olefins of five to eight carbon atoms into smaller olefins. The presence of this specific component, such as a zeolite of the pentasil family, for example, in itself only increases the yield of light olefins.

In order to increase the yield of light olefins, the reaction temperature can also optionally be increased, to a temperature which can be greater than 600° C. at the reactor outlet. This temperature is considered very high for a temperature at the metallurgical limit for materials commonly used to construct the reactors and other apparatus of a UFCC.

Especially when the reaction temperature is over 580° C., a very high circulation of catalyst is required, and this can lead to instability in the flow of the catalyst and the pressure profile within the reactor. This instability results in piston flow of the catalyst and provokes sudden changes in pressure along the length of the riser which make control of the process extremely difficult.

High reaction temperatures also adversely affect the selectivity of the cracking reactions, with undesirable increases in yields of methane and ethane. The resulting decrease in the average molecular weight of the gaseous fraction produced and the increase in the specific volume of the gas mean that the capacity of the UFCC gas compressor needs to be greater.

Another negative aspect of high reaction temperatures is that they are conducive to the formation of aromatic hydrocarbons which have boiling points in the gasoline and light cycle oil (LCO), but show little reactivity in catalytic cracking and interrupt the sequence of reactions leading to the light products desired.

Yet another negative aspect of high temperatures is the production of butadienes, the concentration of which in the gas fraction increases linearly with the reaction temperature; these are precursors of coke, which deposits in the transfer line and the reactor tank.

In addition to the aspects of reaction temperature and catalyst specificity for the cracking reactions desired in an FCC process, another important aspect is the initial contact between the catalyst and the feedstock. This decisively influences the conversion and selectivity of the process in producing more noble products.

In a UFCC operating under conventional conditions, a hydrocarbon feedstock is preheated and injected close to the base of the reactor, where it makes contact with the catalyst flow, by which it is heated sufficiently to vaporize and satisfy the requirement of the endothermic cracking reactions which predominate in the process. In order for the catalytic cracking reactions to proceed preferentially, vaporization of the feedstock in the region of contact with the catalyst needs to occur rapidly so that the molecules of the vaporized hydrocarbons can make contact with the catalyst particles, permeating through the micropores and reacting with the acid sites. Non-occurrence of this rapid vaporization results in thermal cracking of the liquid phase of the feedstock, favouring the formation of by-products such as coke and fuel gas, especially when processing residue feedstocks. Thus, thermal cracking reactions at the base of the reactor in a UFCC compete with the catalytic cracking reactions which are the object of the process.

Various patent documents propose additional injection of an auxilliary fluid, such as water or other petroleum fractions, for "quenching", rapid cooling, at a point above the mixing point of the catalyst and the cracking feedstock in a UFCC. In most cases the principal objective disclosed is to provide a high temperature in the mixing region in order to increase percentage vaporization and thermal cracking reactions of residue feedstocks without changing the outlet temperature of the reactor.

This approach is described in U.S. Pat. No. 4,818,372, which teaches a process and apparatus for catalytic cracking of hydrocarbon feedstocks with reaction-temperature control, which includes an upflow or downflow cracking column with means for introducing a feedstock containing at least 10% of hydrocarbons with a boiling point greater than 500° C. into contact with a recycled catalyst regenerated at a temperature sufficient to vaporize the entire feedstock and promote the initial thermal cracking of the heavier hydrocarbons. Downstream of the zone where the feedstock and the catalyst make contact, at least one means injects an auxiliary fluid in order to rapidly decrease the temperature of the mixture between 10 and 70° C. This gives a moderated temperature to promote the cracking reactions in the reactor with the object of controlling the temperature profile in the reactor, maintaining the initial region at a higher temperature, without altering the temperature at the top of the reactor, also termed the reaction temperature, or TRX. This control can also be effected by recycling heavy naphtha, as taught in U.S. Pat. No. 5,087,349.

U.S. Pat. No. 5,389,232 teaches a process combining the use of an additive, ZSM-5, in an FCC catalyst, with the quenching effect of injecting a fluid to at least one point in the reaction medium. This produces a cracking reaction section covering 10-85% of the length of the reaction, which gives higher yields of light C3/C4 hydrocarbons without adversely affecting the yield of gasoline, and an increase of less than 10% in coke compared with the process without quenching. In this case the process is limited to relatively mild processing conditions, when yields of ethene are necessarily low.

U.S. Pat. No. 4,764,268 presents injection of light cycle oil (LCO) at the top of the reactor in order to minimize over-cracking of naphtha. A similar alternative is taught by U.S. Pat. No. 5,954,942 in order to increase conversion by means of quenching with an auxiliary flow of vapour in the upper section of the reactor.

U.S. Pat. No. 6,416,656 teaches a process for simultaneously increasing yields of diesel oil and liquefied gas (LPG). In this process, gasoline is recracked in order to increase the yield of LPG, being injected at a point below the feedstock inlet. The feedstock for the process can be injected at multiple points along the length of the reactor, decreasing contact time and thus increasing the yield of light cycle oil (LCO).

U.S. Pat. No. 5,846,402 also relates to a process for selective cracking of a petroleum hydrocarbon fraction in order to produce LPG and light olefins of three to four carbons, $C3^{=}$ and $C4^{=}$, under cracking conditions by introducing a cooling fluid in the proportion 3 to 50 wt % relative to the feedstock. The object of this process is to obtain yields of LPG of 40 to 65 wt % relative to the feedstock, with selectivity for olefins of at least 40 wt % for light olefins and selectivity for LPG of at least 45 wt %. However, since the quenching fluid is introduced at the outlet of the reactor (riser), the hydrocarbons are subjected to high temperatures for at least two seconds, which increases the yield of undesirable thermal cracking by-products. Moreover, the high quantities of catalyst circulated in order to maximize the production of light olefins means that high flow rates of carrier vapour need to be used in order to guarantee catalyst flow.

Therefore, despite the long existence of FCC processes, there is still a search for alternatives which could increase the yield of products with higher added value, such as gasoline and light olefins, which are starting materials for the petrochemical industry.

These products can usually be maximized in two ways: one is by increasing so-called "conversion", with a reduction in the production of heavy products such as clarified oil and light cycle oil; the other is by decreasing the yields of coke and fuel gas, or by decreasing "selectivity" for these undesirable by-products.

As described below, the present invention advantageously gives gains in conversion and selectivity for production of light olefins, above all propene, and principally ethene, with simultaneous inhibition of secondary reactions undesirable for the FCC process.

SUMMARY OF THE INVENTION

Broadly speaking, the object of the present invention is to maximize the production of olefins in a UFCC operating in petrochemical mode.

The process limits extreme temperature conditions to the initial section of the reactor, by injecting a current of rapid cooling fluid ¼ to ¾ of the reactor above the feedstock injection point, to obtain a quenching effect and create an initial section of the reactor with higher temperatures and a second section with lower temperatures.

This increases the yield of light olefins, propene $C3^{=}$ and mainly ethene $C2^{=}$, by at least 10 wt % and also inhibits formation of by-products undesirable for the process, when compared to the process without the quenching effect.

The quenching effect is obtained by rapid cooling of the reaction medium, preferably by using water and/or hydrocarbons which vaporize and rapidly remove heat from the system.

The injection of a rapid cooling fluid at a specific point above the initial point of contact of the feedstock with the catalyst has the additional benefit of increasing conversion, especially when processing heavier feedstocks, such as gas oil and atmospheric residues.

As an additional advantage, the injection of the cooling liquid aids the flow of the catalyst along the length of the reactor.

As a result, the injection of the cooling fluid in the initial portion of the reaction brings a series of advantages for the process of maximizing light olefins: it affects the thermal balance of the process and increases circulation of the catalyst; and it cools a section of the reactor, inhibiting undesirable reactions and contributing to the stability of the catalyst flow.

Thus, the temperature profile obtained due to the quenching effect makes it possible to capitalize upon the benefits of the high temperature at the base of the reactor so as to promote the initial cracking reactions and decrease some disadvantages, such as thermal cracking of hydrocarbons, with the production of by-products undesirable for the process.

As yet another advantage, the temperatures attained at the top of the reactor are more compatible with the materials commonly used to manufacture reaction vessels, cyclones transfer lines and other critical equipment of a UFCC, thereby minimizing wear of the same.

SIMPLIFIED DESCRIPTION OF THE DRAWINGS

FIG. 1 illustrates the flow in the processes of the present invention, including the following:

A UFCC reactor (1), a rectifier (3) and a regenerator (2).

Figure 2:
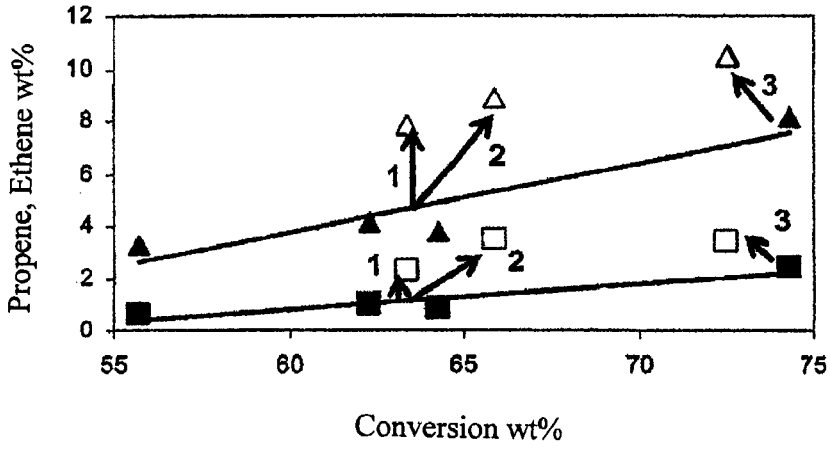

FIG. 2 facilitates the visualization of the increases in selectivity and conversion for light olefins, and especially propene $C3^{=}$ and ethene $C2^{=}$, obtained by the process of the present invention.

DETAILED DESCRIPTION OF THE INVENTION

Usually when FCC processing of hydrocarbon streams from petroleum refining with the object of maximizing production of light olefins, extremely severe operating conditions are applied, which are not observed in the process described below.

In a UFCC for the process of the present invention, the reactions proceed in a tubular reactor with a rising flow, in which the catalyst, in the form of solid particles is carried by the vapour produced by the cracking reactions and by other auxiliary vapours introduced in the process.

The velocity of the vapours should be sufficient to guarantee a stable flow of catalyst, with an auxiliary vapour, termed a carrier vapour being injected below the feedstock injection point, to carry the suspended catalyst to the feedstock inlet ports. Thus, the liquid feedstock injected close to the base of the reactor is vaporized and reacts, forming products, which for the most part are vaporized and contribute to carrying the catalyst particles along the whole length of the tubular reactor (riser). And at the top of the reactor a series of cyclones separate the reaction products.

As the catalyst promotes cracking reactions throughout the reactor, it is also deactivated by the coke formed as a by-product of the reactions.

After the reactor, the deactivated catalyst is rectified by injecting vapour, which separates the volatile hydrocarbon products carried by the catalyst.

Then, in the regenerator, the coke deposited on the surface of the catalyst is burned off, to give the regenerated catalyst, which is returned at a high temperature to the base of the reactor, starting a new cycle of process reactions by contact with a new feedstock fed to the reactor.

Thus the catalytic cracking process of the present invention, aimed at maximizing production of light olefins, above all propene and principally ethene, with gains in selectivity and conversion in a UFCC, comprises the following steps:

a) introduction of a feedstock constituted by a hydrocarbon stream from petroleum refining with an initial boiling point higher than 220° C. at a point at the base of an FCC reactor, to make contact with a catalyst bed diluted with a minimum flow of carrier vapour in a first reaction section, at a temperature sufficient to totally vaporize the feedstock fed to the reactor and promote cracking reaction;

b) injection of a rapid cooling fluid in a proportion 5 to 30% by weight of the flow of feedstock at least one point ¼ to ¾ above the point at which the feedstock is introduced into the reactor, so as to create a second reaction section; and c) recovery of the products discharged at the top of the reaction, with a gain in conversion and a gain in selectivity of greater than 10 wt % for production of propene and ethene when compared with the process without injecting the rapid cooling fluid.

The schematic drawing in FIG. 1 is a simplified illustration of the flow in the process of the invention, including a UFCC reactor (1), rectifier (3) and regenerator (2), wherein:

- a hot catalyst from the regenerator (2) is directed through a transfer line (12) to the base of the reactor (1) and a stream of carrier vapour (4) is injected at the base of the reactor (1), to carry the suspended catalyst to the ports (5) for injecting the hydrocarbon feedstock into the reactor (1), initiating the cracking reactions;
- a rapid cooling liquid is injected at a point (6), decreasing the temperature of the reaction mixture and aiding the flow of the catalyst;
- the vapour from the top of the reactor is directed to a vessel (3), within which a set of cyclones separate the deactivated catalyst from the reaction products, with these products being directed to the transfer line (8) and recovered;
- the deactivated catalyst, which falls to the bottom of the vessel (3), is rectified by injecting vapour (13) in order to recover volatile products carried by the catalyst;
- the rectified catalyst is taken by the transfer line (9) to the regenerator (2), with air (10) being injected into the bottom of the regenerator (2) in order to burn the coke by-product of the reactions, generate the heat necessary for the process, and prepare the catalyst for a new cycle.

As the examples below indicate, the feedstock for the process can be constituted by streams from petroleum refining which contain hydrocarbons with boiling points higher than 220° C., typical of diesel oil and or heavier products from an atmospheric distillation unit.

Depending on the feedstock, the catalyst can include a typical FCC catalyst in a proportion of 10 to 90% mixed with a catalyst specific for production of light olefins, where the typical catalyst can contain as principal active constituent a zeolite Y, and the specific catalyst can contain as principal active constituent a zeolite of the pentasil family.

The objective of the specific catalyst is to convert larger olefins, with boiling points typical of gasoline, into smaller olefins of four to two carbon atoms, shifting the selectivity of the FCC in the direction of liquefied gas (LPG), while decreasing gasoline. Specific catalysts of zeolite ZSM5, with pores of 6 to 7 Å, for example, can be used. On the other hand, a typical catalyst of zeolite "Y", with pores of the order of 8 to 9 Å, allows cracking of larger molecules, improving the conversion of the process for feedstocks of heavier hydrocarbons, as indicated in tests "G" and "H" in Table 2 in this document, where the inclusion of the specific catalyst "Z" (ZSM5) led to a loss of two points in conversion.

In addition to a catalyst system which includes a specific catalyst, the present invention uses a rapid cooling fluid in order to improve selectivity and conversion to produce light olefins.

As the rapid cooling fluid, water, hydrocarbons with a boiling point in the naphtha range, including recycled naphtha or a constituent fraction of the feedstock, or even the feedstock itself, in a smaller quantity, or a mixture of these fluids in any proportions can be injected.

The flow rates recommended for the rapid cooling fluid are in the range 5 to 30% relative to the mass flow rate of the feedstock, or preferably in the range 5 to 20%, so as to bring about a quenching effect and create two reaction sections in the reactor.

Injecting a rapid cooling fluid into the reaction medium, especially when this is done in the first half of the reactor, has the additional advantage of aiding the flow of the catalyst and enabling partial substitution of the carrier vapour introduced at the base of the reactor. As a result, the injection of the cooling fluid in the initial portion of the reaction brings a series of advantages for the process of maximizing light olefins: it affects the thermal balance of the process and increases circulation of the catalyst; and it cools a section of the reactor, inhibiting undesirable reactions and contributing to the stability of the catalyst flow.

Thus, the present invention relates to a process for fluidized catalytic cracking of a petroleum hydrocarbon fraction, which maximizes the production of light hydrocarbons, and especially of propene $C3^{=}$ and ethene $C2^{=}$, and also inhibits secondary reactions undesirable for the process, showing itself to be a process with a controlled temperature profile and stable catalyst flow in the reactor.

These process characteristics are obtained by injecting a rapid cooling fluid which vaporizes rapidly causing quenching of the reaction medium and producing a temperature profile in the reaction which is different from that with conventional operation, so that a higher temperature is maintained at the base of the reactor and two reaction sections are created along the length of the reactor: a first section which favours the primary reactions which produce the olefins which are the precursors of light olefins, and a second section which favours only the secondary reactions which produce the products desired from the process.

The primary reactions, which occur mainly in the first reaction section, convert the hydrocarbons of more than eight carbon atoms present in the feedstock into smaller molecules, and are favoured by high temperatures. The desired secondary reactions, on the other hand, which convert olefins of 8 to 5 carbon atoms into olefins of 3 to 2 carbon atoms, do not need such extreme temperatures and can continue in the second part of the reactor. By contrast, secondary reactions of thermal cracking and hydrogen transfer are strongly inhibited by the lower temperatures in the second section of the reactor, so that this decreases the yield of by-products undesirable for the process, such as methane and the butadienes.

Maximized production of light olefins is demonstrated by the products discharged from the top of the reactor, with yields of propene $C3^{=}$ and ethene $C2^{=}$ increased by at least 10 wt % compared with the process without quenching using a rapid cooling fluid. The ethene is separated from the fuel gas fraction (FG), and the propene is separated from the liquefied gas fraction (LPG), so identified in the tables giving the results of tests in the examples which demonstrate the gains in selectivity and conversion obtained by means of the process of the invention. Ethene, which in the conventional FCC process is farther from its maximum yield, shows a more pronounced increase than propene as the result of using quenching in the process.

Therefore, the process provides both the thermal effect and also the increase in circulation to stimulate the reactions which occur in the first instance after contact between the catalyst and the feedstock, with a minimum quantity of carrier vapour to guarantee the stability of the system. These reactions are decisive for the conversion of hydrocarbons in heavier feedstocks into olefins of more than five carbon atoms, the precursors of light olefins. And the injection of a rapid cooling fluid has the advantage of aiding the flow of the catalyst along the length of the reactor, in addition to producing a quenching effect and inhibiting secondary reactions undesirable for the process. The results of these gains in the process can be demonstrated by the examples presented below, without these limiting the scope of the invention.

EXAMPLES

Two series of tests are presented, Examples I and II, conducted in a prototype FCC unit with recycling, provided with a reactor 18 m long enabling injection of fluids at points situated between ¼ and ¾ of the reactor above the feedstock introduction point. The reactor, rectifier and regenerator of the unit operate adiabatically, enabling precise reproduction of the thermal effects in an industrial scale UFCC.

Example I

This example illustrates the effects of quenching in maximizing the production of light olefins ($C2^{=}$ and $C3^{=}$) from a diesel oil fraction, with controlled process variables.

Feedstock—diesel oil 33.7° API, distillation D86 T10=180° C., T50=282° C. and T90=380° C.

Catalyst—A typical FCC catalyst containing zeolite Y, and a catalyst specific for light olefins containing zeolite ZSM5.

Rapid cooling fluid—Water for quenching.

Table 1 summarizes the tests and the results obtained.

TABLE 1

| | TEST | | |
|---|---|---|---|
| | A | B | C |
| Conditions | | | |
| Reaction temperature ° C. | 580 | 580 | 600 |
| Temperature of the dense phase ° C. | 721 | 720 | 720 |
| Pressure in the reactor kPa | 157 | 157 | 157 |
| Feedstock flow rate kg/h | 65 | 65 | 60 |
| Water flow rate kg/h | | 13 | |
| Point of quenching in the reactor | | ¼ | |
| Carrier vapour wt % | 27 | 7 | 25 |

TABLE 1-continued

| | TEST | | |
|---|---|---|---|
| | A | B | C |
| Balance relative to the feedstock | | | |
| FG - Fuel gas wt % | 6.9 | 8.7 | 9.3 |
| LPG - Liquefied gas wt % | 18.4 | 21.6 | 21.3 |
| Gasoline (C5-220° C.) wt % | 34.4 | 34.0 | 35.5 |
| Coke and 220° + wt % | 40.3 | 35.6 | 33.8 |
| Total wt % | 100 | 100 | 100 |
| Results relative to the feedstock | | | |
| Conversion wt % | 60.6 | 65.7 | 67.2 |
| $C3^{=}$ wt % | 10.5 | 11.9 | 12.3 |
| $C2^{=}$ wt % | 4.1 | 5.2 | 5.4 |
| C1 wt % | 1.6 | 2.0 | 2.3 |
| Butadienes wt % (in the gas) | 0.4 | 0.3 | 0.5 |

It can be seen that the quenching effect in the process of the invention advantageously resulted in an increase in conversion of 5 points, an increase in the yield of propene of 1.4 points ($C3^{=}$, 13 wt %), and an increase in the yield of ethene of 1.1 points ($C2^{=}$, 27 wt %), when Test B (process of the invention) is compared with Test A, under the same operating conditions except for quenching. It can also be seen that in order to obtain the same yields of ethene and propene, in Test C (without quenching), there was an undesirable increase in thermal cracking due to the increase of 20° C. in temperature, shown by the increases in the yields of methane and butadienes, compared both with Test A and with Test B (process of the invention). The use of quenching water at 13 kg/h (20% of the flow of feedstock) in Test B (process of the invention) replaced an equal quantity of carrier vapour, which could be decreased without adversely affecting the stability of the catalyst flow compared with Tests A and C.

Example II

This example illustrates cracking of a hydrocarbon feedstock from an atmospheric residue from petroleum refining to maximize light olefins, with different reaction temperatures and catalyst compositions, demonstrating the gains obtained with the process of the invention (Test J) by injecting a cooling fluid at the midway point of the reactor of the unit.

Feedstock—atmospheric residue (ATR), density 19.9° API, and Conradson carbon residue—CCR 6.5 wt %. Catalyst—typical FCC catalyst (Y) for ATR, constituted by an equilibrium catalyst recovered from a residue cracking unit, and containing rare earths 2.4%, nickel 4200 mg/kg, vanadium 5500 mg/kg (metals contaminating the catalyst) and 120 $m^2/g$ specific surface area; and a specific catalyst containing zeolite ZSM-5.

Rapid cooling fluid—Water for quenching.

Table 2 summarizes the conditions of the tests, product yields and the principal results obtained in this series of tests.

TABLE 2

| | TEST | | | | | | |
|---|---|---|---|---|---|---|---|
| | D | E | F | G | H | I | J |
| Conditions | | | | | | | |
| Reaction temperature ° C. | 520 | 540 | 545 | 580 | 580 | 545 | 544 |
| Catalyst | Y | Y | Y | Y | Y + Z | Y + Z | Y + Z |
| Feedstock flow rate kg/h | 128 | 128 | 130 | 130 | 130 | 130 | 130 |
| Water flow rate kg/h | | | | | | 7.8 | 7.8 |
| Point of quenching in the reactor | | | | | | Base | ½ |
| Yields relative to the feedstock | | | | | | | |
| FG - Fuel gas wt % | 2.8 | 3.8 | 3.2 | 7.1 | 7.7 | 4.8 | 6.4 |
| LPG - Liquefied gas wt % | 9.3 | 11.4 | 10.8 | 19.7 | 22.7 | 17.3 | 17.8 |
| Gasoline wt % | 34.9 | 38.0 | 40.6 | 36.6 | 31.6 | 32.9 | 32.7 |
| Light cycle oil wt % | 17.8 | 18.3 | 18.0 | 14.5 | 15.0 | 16.1 | 16.5 |
| Diesel oil wt % | 26.5 | 19.5 | 17.7 | 11.2 | 12.5 | 20.5 | 17.6 |
| Coke wt % | 8.8 | 9.0 | 9.8 | 10.9 | 10.4 | 8.5 | 9.0 |
| Total wt % | 100.0 | 100.0 | 100.0 | 100.0 | 100.0 | 100.0 | 100.0 |
| Results relative to the feedstock | | | | | | | |
| Conversion wt % | 55.7 | 62.3 | 64.3 | 74.3 | 72.5 | 63.4 | 65.9 |
| $C3^{=}$ wt % | 3.3 | 4.2 | 3.8 | 8.1 | 10.5 | 7.9 | 8.9 |
| $C2^{=}$ wt % | 0.7 | 1.0 | 0.9 | 2.4 | 3.4 | 2.2 | 3.5 |
| C1 wt % | 0.9 | 1.4 | 1.2 | 2.8 | 2.4 | 1.4 | 1.6 |
| Vol gas $NL^3/kg$ | 89.3 | 112.0 | 96.9 | 189.2 | 208.7 | 151.9 | 166.5 |

In Tests D-G the only change was an increase in temperature in the range 520° C. to 580° C., with the other process conditions maintained constant, without injection of the rapid cooling fluid, in order to demonstrate the effect of the variable temperature on maximizing production of light olefins. An increase is seen in production of propene $C3^{=}$, and principally in ethene $C2^{=}$ from 3.3 and 0.7 to 8.1 wt % (145%) and 2.4 wt % (242%) relative to the feedstock.

However, the increased yield of methane (211%) and increase in the specific volume of gas (112%) indicated the occurrence of reactions undesirable for the process, as expected.

Compared with Test G, in Test H the temperature was maintained at 580° C., and the specific catalyst (Z) was added to the typical catalyst (Y). Gains were seen in production of light olefins, which are associated with the higher yields of LPG and FG and lower yield of gasoline, which was the result expected from only adding the specific catalyst.

Zeolite ZSM-5, being extremely specific for olefins, resulted in an increase in the specific volume of gas of only 10%.

In Tests I and J, water was injected into the reactor at two different points: before introducing the feedstock, and at the halfway point of the reactor (to give the quenching effect in the process of the invention). An increase is seen in the yield of light olefins propene ($C3^{=}$, 13%) and principally ethene ($C2^{=}$, 59%) corresponding to the effect of quenching the Test J (process of the invention).

The effect of injecting water at the base of the reactor is seen by comparing Test I and Test F, with equivalent process conditions, with an increase in selectivity but not in conversion.

In order to facilitate the visualization of the increases in selectivity and conversion for light olefins, and especially propene $C3^{=}$ and ethene $C2^{=}$, obtained by the process of the present invention, FIG. 2 presents some of the results of the tests in Table 2.

In FIG. 2 the increase in conversion to light olefins propene (▲) $C3^{=}$ and ethene (■) $C2^{=}$ produced by increasing the reaction temperature under conventional FCC operating conditions can be easily seen.

The gains in selectivity of the process for producing light olefins (arrow 3), propene (Δ) and ethene (□) when a catalyst specific for light olefins is added to a typical FCC catalyst, comparing Test G with Test H, is also demonstrated. However, since the additive zeolite ZSM-5 has no activity for cracking of larger molecules, there is also a small loss in conversion in the FCC process.

On the other hand, when the specific catalyst is used and water is injected at the base of the reactor (arrow 1), an increase is seen in the yield of light olefins, without any gain in conversion.

However, advantageous gains in conversion and the selectivity can be seen with the process of the invention (arrow 2), when the specific catalyst is used and a quenching effect is obtained by injecting water at the midway point of the reactor. Comparing Test J (process of the invention) with Test F, the quenching effect increased the yield of propene from 3.8 to 8.9 wt % relative to the feedstock (134%), and an even greater increase can be seen in the yield of ethene, from 0.9 to 3.5 wt % relative to the feedstock (289%). Moreover, an advantageous increase is also seen in conversion, from 64% to 66 wt %, with inhibition of coke formation, from 9.8 para 9.0 wt %.

Therefore, the process described for a UFCC makes possible gains in selectivity and conversion for production of light olefins and especially propene and principally ethene, by cracking reactions, inhibiting secondary reactions undesirable to the process and further offering additional gains in the energy balance of the unit.

The invention claimed is:

1. Process for fluidized catalytic cracking, operating in petrochemical mode, of a petroleum hydrocarbon fraction, for increasing production of light olefins, characterized in that it comprises the following steps:

a) introduction of a feedstock constituted by a hydrocarbon fraction from petroleum refining with an initial boiling point higher than 220° C. at an inlet port close to the base of an FCC reactor, to make contact with a mixed zeolites catalyst diluted with a minimum flow of carrier vapor, so as to guarantee a stable flow of catalyst and a higher temperature to totally vaporize the feedstock into the reactor, initiating primary catalytic cracking reactions in a first reaction section, said mixed zeolites catalyst comprising a proportion of 10 to 90% by weight of a zeolite Y mixed with a specific catalyst zeolite Z for catalytic cracking olefin precursors of light olefins;

b) injection of a rapid cooling fluid which aids the minimum flow of the carrier vapor in a proportion of 5 to 30% by weight of the flow of feedstock at least one point ¼ to ½ above the feedstock inlet port, creating a second reaction section for secondary catalytic cracking reactions at lower temperatures; and c) recovery of the products discharged at the top of the reactor, with a gain in conversion and a gain in selectivity of greater than 10 wt % for production of propene and greater than 50 wt % for ethene, in detriment of gasoline yields, when compared with the process without injecting the rapid cooling fluid.

2. Process according to claim 1, characterized in that the feedstock comprises a diesel oil fraction.

3. Process according to claim 1, characterized in that the feedstock comprises a residual fraction from atmospheric distillation of petroleum.

4. Process according to claim 1, characterized in that the specific catalyst Z contains as principal active constituent a zeolite of the pentasil family.

5. Process according to claim 1, characterized in that the cooling fluid is injected in the first half of the reactor.

6. Process according to claim 1, characterized in that the cooling fluid is injected in a proportion of 5 to 20% of the feedstock.

7. Process according to claim 6, characterized in that the rapid cooling fluid is constituted by water, hydrocarbons with a boiling point in the naphtha range, recycled naphtha or a constituent fraction of the feedstock.

8. Process according to claim 6, characterized in that the rapid cooling fluid is a mixture of water and hydrocarbons in any proportion.

9. Process according to claim 6, characterized in that the cooling fluid is the feedstock itself, injected in a quantity smaller than that introduced at the base of the reactor.

10. Process according to claim 1, characterized in that the first reaction section corresponds to conditions favoring the primary catalytic cracking reactions of the hydrocarbons in the reactor.

11. Process according to claim 1, characterized in that the second reaction section corresponds to conditions favoring the secondary reactions producing light olefins and unfavorable for thermal cracking reactions.

* * * * *